US005806039A

United States Patent [19]

Fukada et al.

[11] Patent Number: 5,806,039

[45] Date of Patent: Sep. 8, 1998

[54] DATA PROCESSING METHOD AND APPARATUS FOR GENERATING SOUND SIGNALS REPRESENTING MUSIC AND SPEECH IN A MULTIMEDIA APPARATUS

[75] Inventors: Toshiaki Fukada; Yasunori Ohora; Takashi Aso; Mitsuru Otsuka, all of Yokohama, Japan

[73] Assignee: Canon Kabushiki Kaisha, Tokyo, Japan

[21] Appl. No.: 859,092

[22] Filed: May 20, 1997

Related U.S. Application Data

[63] Continuation-in-part of Ser. No. 171,166, Dec. 22, 1993, abandoned.

[30] Foreign Application Priority Data

Dec. 25, 1992 [JP] Japan ..... 4-345865

[51] Int. Cl.[6] ..... G10L 5/02

[52] U.S. Cl. ..... 704/268; 704/260; 704/272

[58] Field of Search ..... 395/2.67, 2.69, 395/2.76, 2.79; 704/258, 260, 267, 268, 272, 270

[56] References Cited

U.S. PATENT DOCUMENTS

| | | | |
|---|---|---|---|
| 3,575,555 | 4/1971 | Schanne | 381/51 |
| 4,577,343 | 3/1986 | Oura | 395/2.67 |
| 4,731,847 | 3/1988 | Lybrook et al. | 381/51 |

OTHER PUBLICATIONS

Proceedings of the second International Conference on Document Analysis and Recognition; Radriamahefa et al, "Printed Music Recognition", pp. 898–901, Oct. 1993.

*Primary Examiner*—Richemond Dorvil
*Attorney, Agent, or Firm*—Fitzpatrick, Cella, Harper & Scinto

[57] ABSTRACT

A data processing apparatus for synchronized audiovisual output has synchronizing signal bits which are assigned to bits of each sound data, represented by a 16-bit PCM code. A predetermined bit of the assigned bits having the least influence upon the human auditory sense is extracted as a synchronizing signal bit for synchronization of the image data output and sound output.

22 Claims, 8 Drawing Sheets

25a

| 25b LYRIC INFORMATION | 25c PITCH INFORMATION | 25d DURATION INFORMATION |
|---|---|---|
| o | Do | 1/4 |
| te | Do | 1/8 |
| - | Re | 1/8 |
| te | Mi | 1/2 |
| ⋮ | ⋮ | ⋮ |

DATA PROCESSING METHOD AND APPARATUS FOR GENERATING SOUND SIGNALS REPRESENTING MUSIC AND SPEECH IN A MULTIMEDIA APPARATUS

This application is a continuation of application Ser. No. 08/171,166 filed Dec. 22, 1993, now abandoned.

BACKGROUND OF THE INVENTION

The present invention relates to a data processing method and apparatus for generating sound signals representing musical sound, speech and the like, in a multimedia apparatus.

Description of the Related Art

Conventionally, when a multimedia device simultaneously outputs a signal for reproducing "sound", e.g., musical sound and speech, from a speaker, and a signal for reproducing a character image on a display, it generates a synchronizing signal for synchronizing the sound with the character image.

In general musical notation of a song and lyrics are provided for a singer who reads the score. For this reason, the lyrics, using KANJI (Chinese character) and KANA (Japanese syllabary), KATAKANA (square form of KANA), alphabet and so on, are placed roughly under corresponding notes according to the musical notation.

However, in the above conventional multimedia apparatus, the newly generated synchronizing signal increases the amount of data. Further, assuming that the apparatus outputs a piece of music with lyrics, i.e., it sings a song, the above notation provides the apparatus with ambiguous information as to the relation between each lyric and its corresponding note. This causes the apparatus to perform an inaccurate and complicated analysis of the score, and as a result, the apparatus may fail to sing correctly.

SUMMARY OF THE INVENTION

The present invention has been made in consideration of the above situation, and has as its first object to provide a data processing method and apparatus for generating a synchronizing signal without increasing the amount of data by assigning a synchronizing signal to a part of the sound data.

Further, the present invention has a second object to provide a score storing and displaying method and apparatus thereof for enabling easy and accurate analysis of a score in order for a machine to generate the sound exactly.

According to the present invention, the first object is attained by providing a data processing apparatus for outputting a sound signal representing musical sound, speech and other computer-generated sounds, and performing image reproduction in synchronization with outputting the sound signal, comprising: reset means for resetting a bit at a predetermined position of sound data having a plurality of bits; setting means for setting a synchronizing signal on the bit reset by the reset means; and sound reproduction means for reproducing the sound data in which the synchronizing signal has been set.

According to the present invention, the second object is attained by providing a data processing apparatus for performing sound-synthesizing based on a musical score with lyrics, comprising: providing means for inputting the musical sound by notes, and providing one or more syllables in correspondence with a note; first extraction means for extracting, as lyric information, the one or more syllables provided by the providing means; second extraction means for determining the pitch of each note based on the position of the note, and extracting the pitch as pitch information; third extraction means for determining a duration of each note based on a characteristic of the note, and extracting the duration as duration information; memory means for storing the respective lyric, pitch and duration information for accessibility of each data in a timely manner; and sound-synthesizing means for performing sound-synthesizing using the lyric information, the pitch information and the duration information accessed from the memory means.

In the data processing apparatus according to the first aspect of the present invention, a bit or a few bits in a predetermined part of the sound data is cleared, and a synchronizing signal is inserted into the bit position. The inserted synchronizing signal and the sound data are extracted, and another processing, e.g., image reproduction is performed in synchronization with the synchronizing signal.

In the data processing apparatus according to the second aspect of the present invention, musical sound is represented by notes, and the lyrics are provided in correspondence with the respective notes. From one note, the vocal information, pitch information and duration information are extracted. The extracted information on the respective notes are synthesized, and provided to a machine to generate the sound.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION QF THE PREFERRED EMBODIMENTS

Preferred embodiments of the present invention will be described in detail in accordance with the accompanying drawings.

First Embodiment

Figure 1:
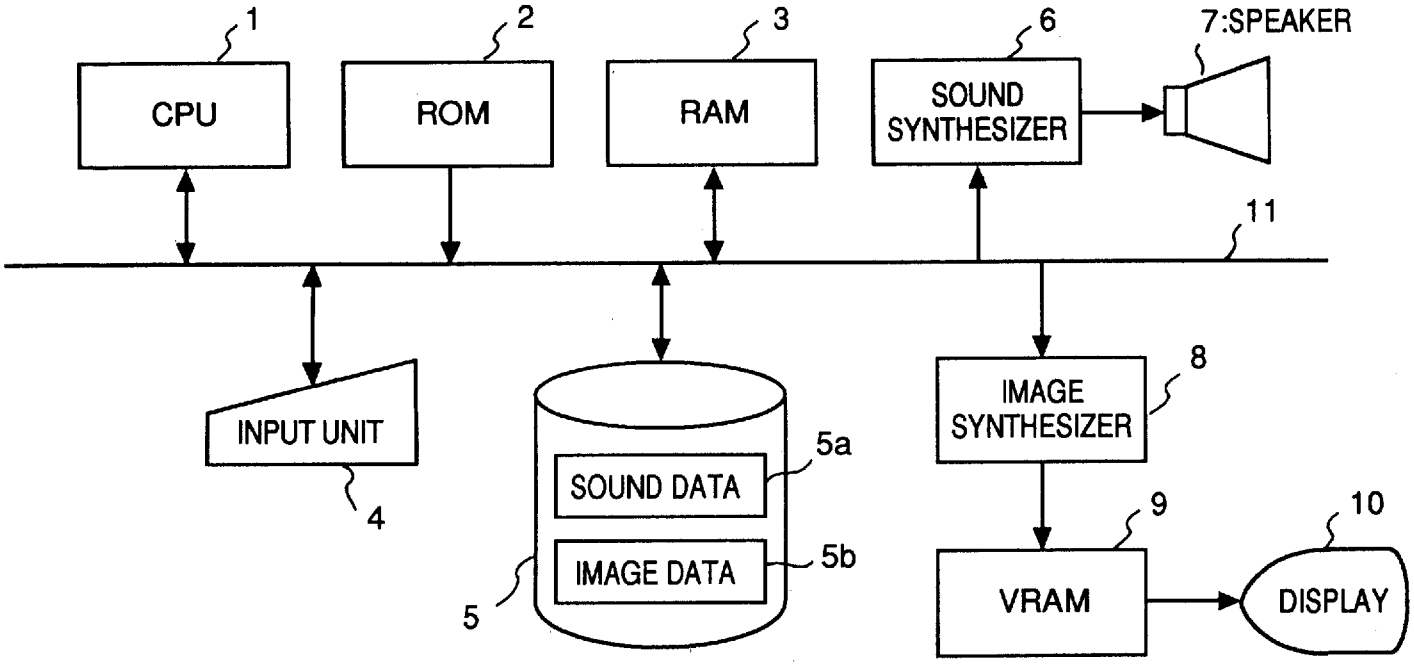
FIG. 1 is a block diagram showing the configuration of a sound/image processing apparatus according to a first embodiment.
Figure 4:
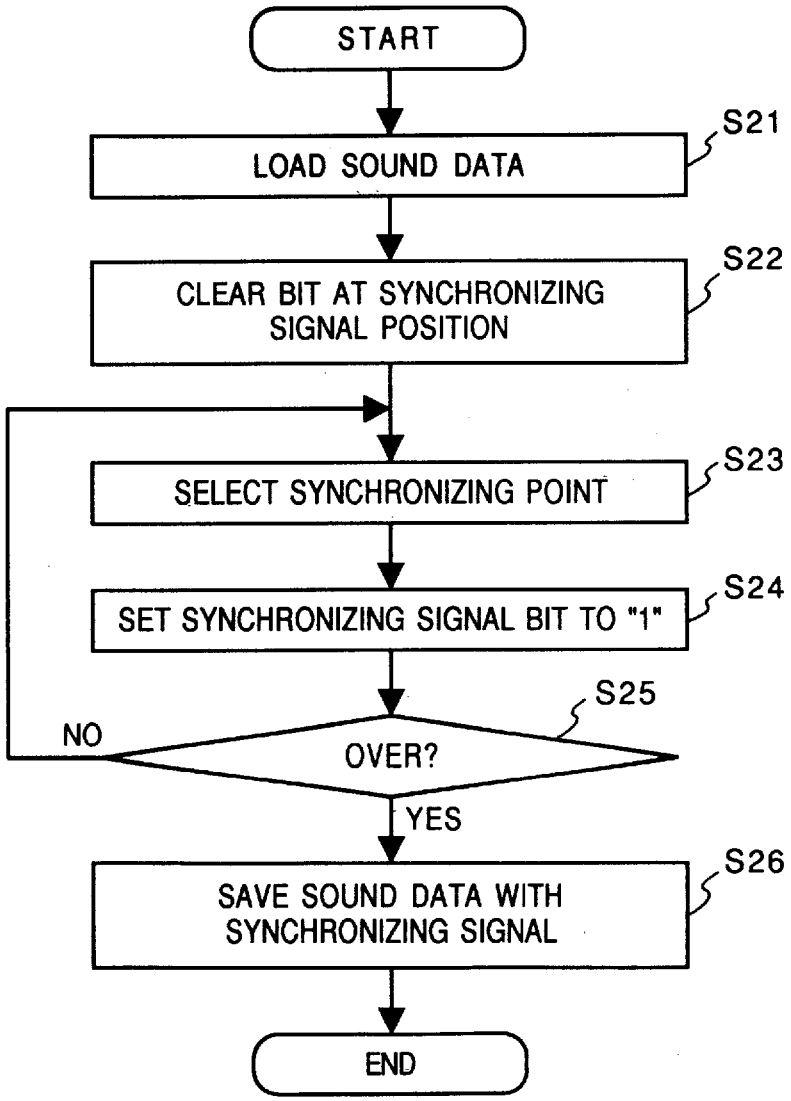
FIG. 4 is a flowchart showing a procedure of inserting the synchronizing signal.

FIG. 1 shows the configuration of a sound/image processing apparatus according to the first embodiment. In FIG. 1, reference numeral 1 denotes a CPU for performing various controls in the sound/image processing apparatus; and 2, a ROM in which control programs for the CPU are stored. The control program represented by the flowchart in FIG. 4 is also stored in the ROM 2. Numeral 3 denotes a RAM for temporarily storing data used by the CPU 1 performing the various controls; 4, an input unit comprising a key board. The user inputs various data and control commands using the input unit 4. Numeral 5 denotes an auxiliary storage comprising, e.g., a magnetic disk. Sound data 5*a* for audio outputting and image data 5*b* are stored in the auxiliary storage 5.

Numeral 6 denotes a sound synthesizer for performing sound synthesizing using the sound data 5*a* read out of the auxiliary storage 5, and for outputting a sound signal to speaker 7. The speaker 7 outputs sound in accordance with the sound signal received from the sound synthesizer 6. Numeral 8 denotes an image synthesizer for converting the image data 5*b*, read out of the auxiliary storage 5, into video image data and storing the data into VRAM (video RAM) 9; and 10, a display for displaying the video image data stored in the VRAM 9.

Figure 2:
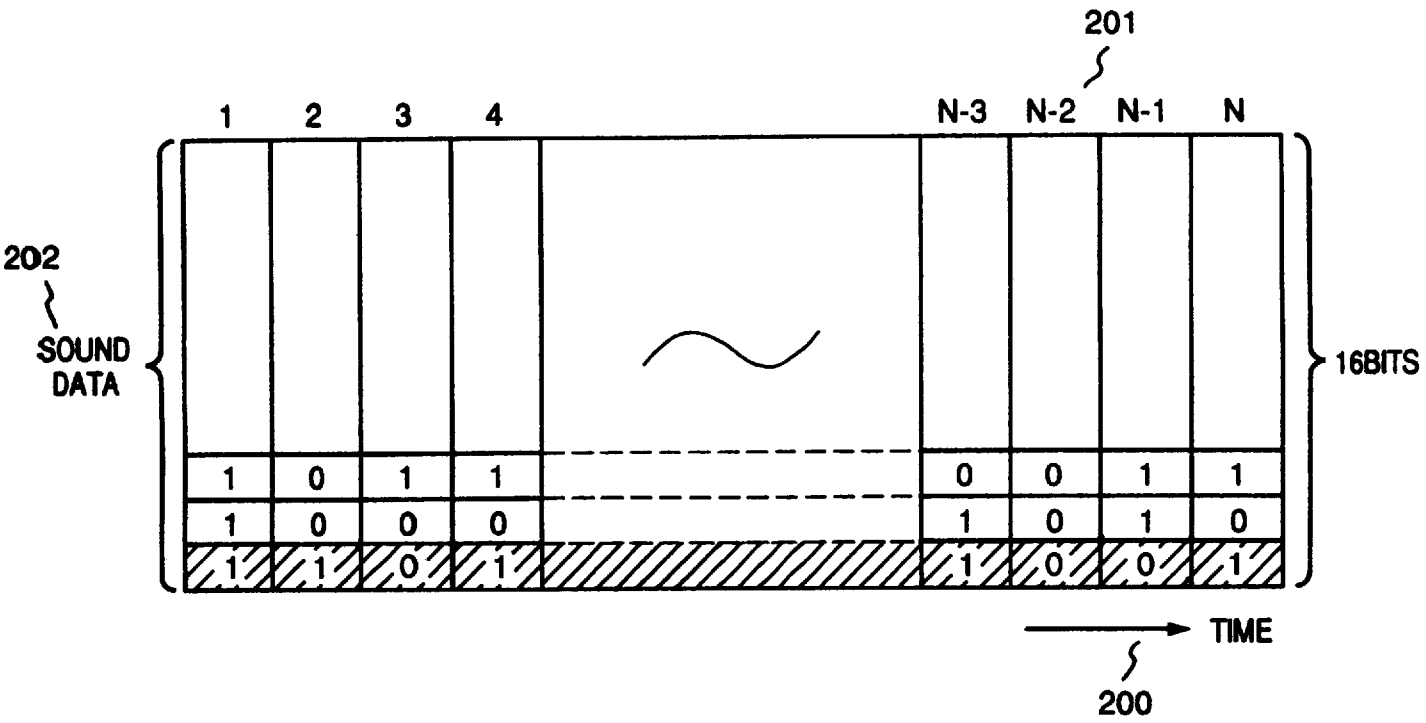
FIG. 2 illustrates the structure of sound data before insertion of a synchronizing signal.

The sound data 5*a* is described below. It should be noted that in the present embodiment, the sound data is a sixteen-bit PCM data. FIG. 2 shows the data structure of the sound data in which a synchronizing signal is not inserted yet. In FIG. 2, the lateral axis 200 is a time axis divided into time intervals 201 each having an integral time value, 1, 2, . . . , N. Each column represents sixteen-bit PCM data 202 corresponding to each time interval 201.

Figure 3:
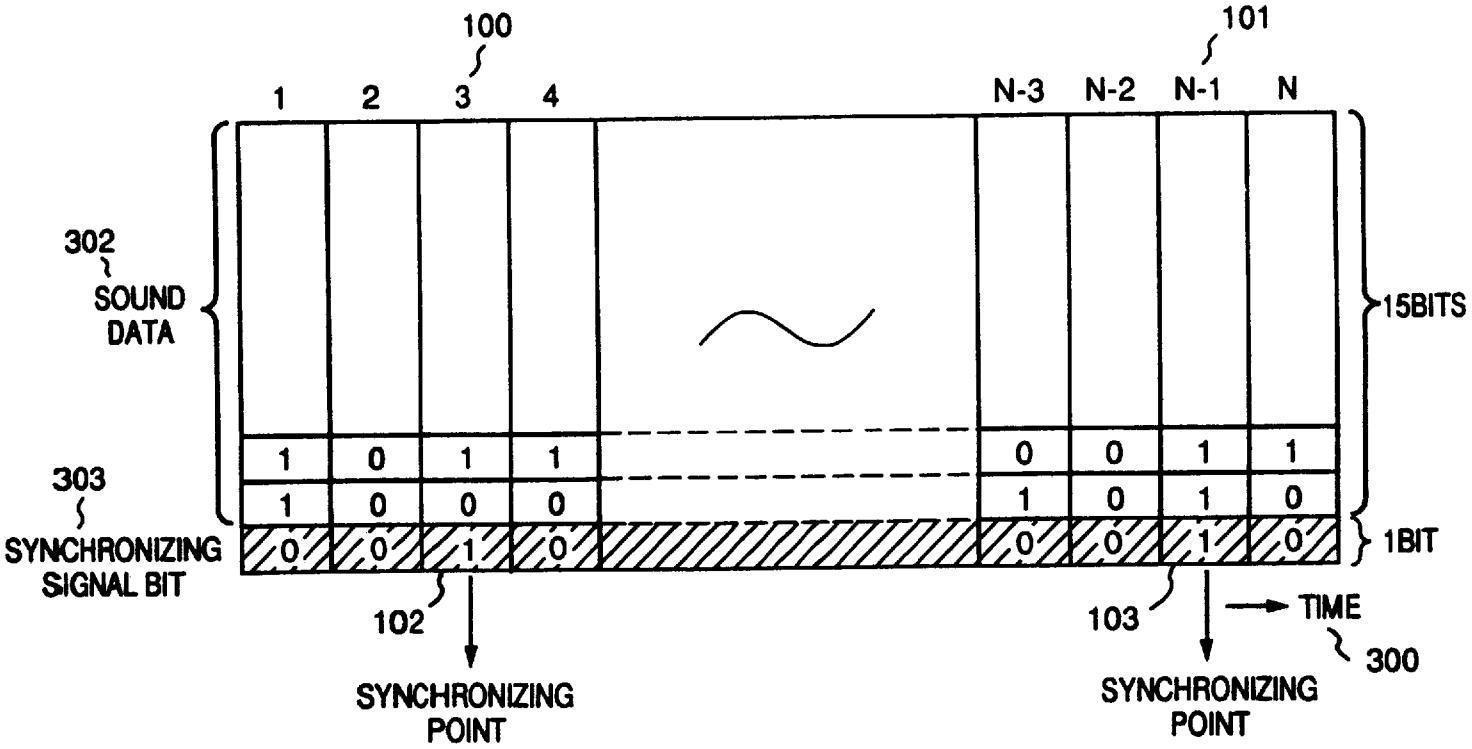
FIG. 3 illustrates the structure of the sound data after the insertion of the synchronizing signal.

FIG. 3 shows data structure of the sound data in which a synchronizing signal is inserted. In FIG. 3, the lateral axis 300 is a time axis identical to that in FIG. 2, and each column represents a sixteen-bit PCM data 302 corresponding to each time interval 201 and synchronizing signal bit 303. The bit position 303 for a synchronizing signal is the part having the least influence upon the human auditory sense. Extracting the synchronizing signal bit obtains a synchronizing signal for simultaneous sound and image outputting.

Next, a procedure of inserting a synchronizing signal into the sound data is described with reference to a flowchart in FIG. 4.

First, the original sound data is loaded in step S21. The original sound data is a sixteen-bit PCM data array as shown in FIG. 2, and it is stored in the auxiliary storage 5.

In step S22, data of the synchronizing signal bit position of each sound data, 303 is set to "0".

In step S23, a synchronizing point to synchronize outputting of the sound data with outputting of image data is determined.

In step S24, a synchronizing signal bit is set to "1" at the synchronizing point determined in step S23. In FIG. 3, a synchronizing signal bit 102 of the time interval 3 (100) and a synchronizing signal bit 103 of the time interval N-1 (101) are each set to "1".

In step S25, whether or not there is any other sound data to be synchronized with the image data is checked. If YES, the process returns to step S23 to repeat the above operation. If NO, the sound data (sound data 5*a*) including the synchronizing signal bits is stored into the auxiliary storage 5 in step S26, and the process ends.

As described above, the sound and image processing apparatus according to the present embodiment uses one bit of the sound data for a synchronizing signal. Thus, the apparatus generates a synchronizing signal without increasing the amount of data. Note that reproduction of sound data with a synchronizing signal has almost no affect on the audience, since the bit position of the synchronizing signal part has the least influence upon the human auditory sense.

Second Embodiment

A sound processing apparatus using a storing and displaying method for a music score with lyrics is described as the second embodiment. The storing and displaying method enables easy and accurate analysis of a song score so that a machine can sing it. In addition, the song score stored and displayed by the sound processing apparatus provides precise and recognizable information to allow the apparatus itself to easily analyze this information, and to allow users to easily input the score data.

Figure 5:
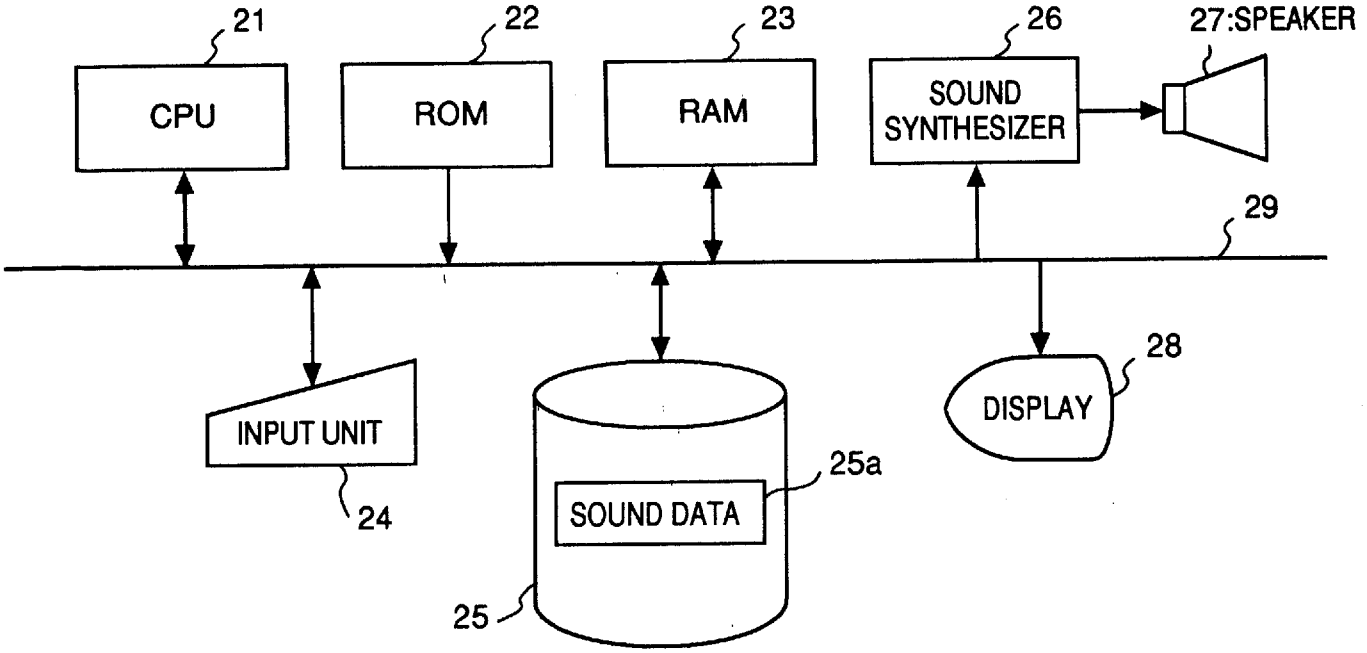
FIG. 5 is a block diagram showing the configuration of a sound processing apparatus according to the second embodiment.
Figure 7:
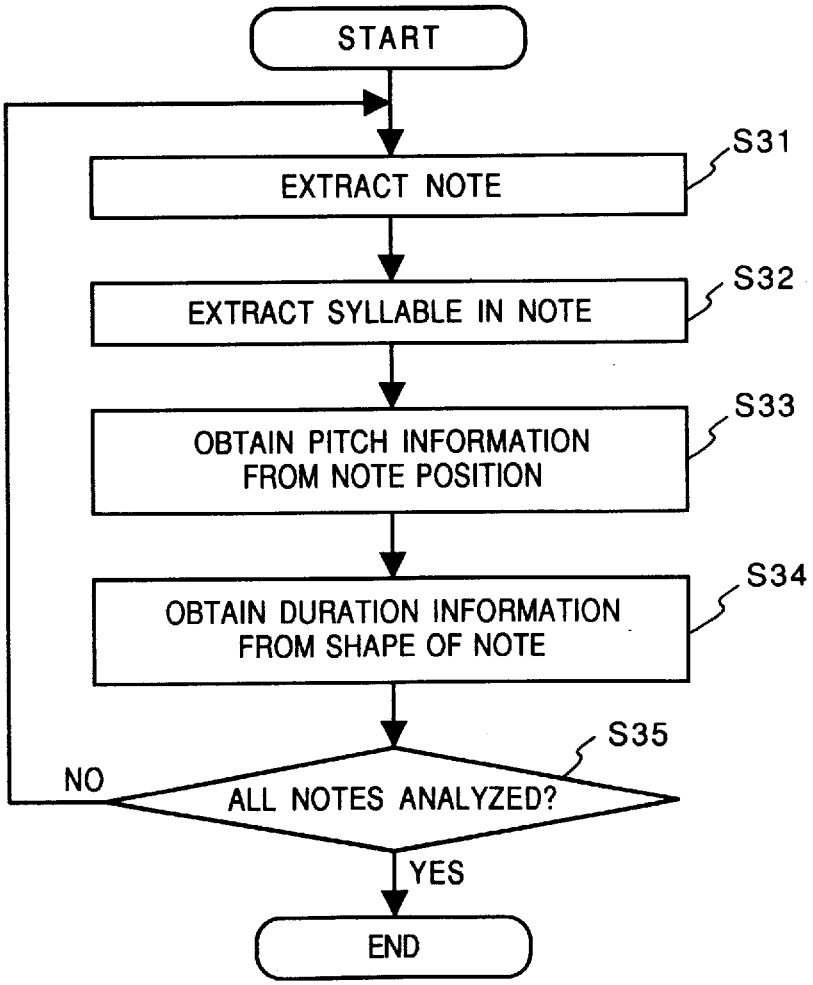
FIG. 7 is a flowchart showing a procedure of analyzing the notation according to the second embodiment.

FIG. 5 is a block diagram showing the configuration of the sound processing apparatus according to the second embodiment. In FIG. 5, reference numeral 21 denotes a CPU for controlling the overall sound processing apparatus; and 22, a ROM in which various control programs to be performed by the CPU 21 are stored. A control program represented by a flowchart in FIG. 7 to be described later is also stored in the ROM 22. Numeral 23 denotes a RAM in which various data are temporarily stored upon performing control by the CPU 21; 24, an input unit for a user to input various data and control commands; 25, an auxiliary storage, comprising e.g. a magnetic disk, for storing sound data 25*a* to be described later; and 26, a sound synthesizer for generating sound signal from the sound data 25*a* read out of the auxiliary storage 25 and for outputting the signal to speaker 27. The speaker 27 reproduces sound in accordance with the received sound signal. Numeral 28 denotes a display for displaying various data.

Figure 6:
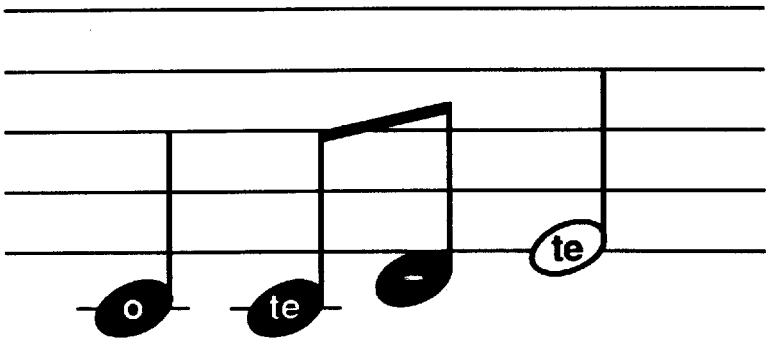
FIG. 6 illustrates a musical notation according to the second embodiment.

FIG. 6 shows a part of a music score displayed on the display 28, in accordance with the displaying method according to the second embodiment.

The score is generated by using the real time data inputting method or the step inputting method. The MIDI (Musical Instrument Digital Interface) format data may be input. Next, a user inputs lyrics letter in correspondence with respective notes. As shown in FIG. 6, the input lyrics are respectively displayed on the heads of the corresponding notes. At this time, letters in white notes, such as a whole note and a half note, are displayed in black (normal displaying), while letters in black notes, such as a quarter note and an eighth note, are displayed in white (reversed-displaying). Thus, the displayed score provides an exact notation in which each note shows the pitch, the duration, and one or more syllables of lyrics corresponding to the note.

It should be noted that the letters may be replaced with phonetic symbols.

The input data as shown in FIG. 6 is stored in the RAM 23. The CPU 21 analyzes the data in accordance with the flowchart in FIG. 7 to be described below.

In step S31, one note to be analyzed is read out of the RAM 23 into the CPU 21.

Figures 8, 9:
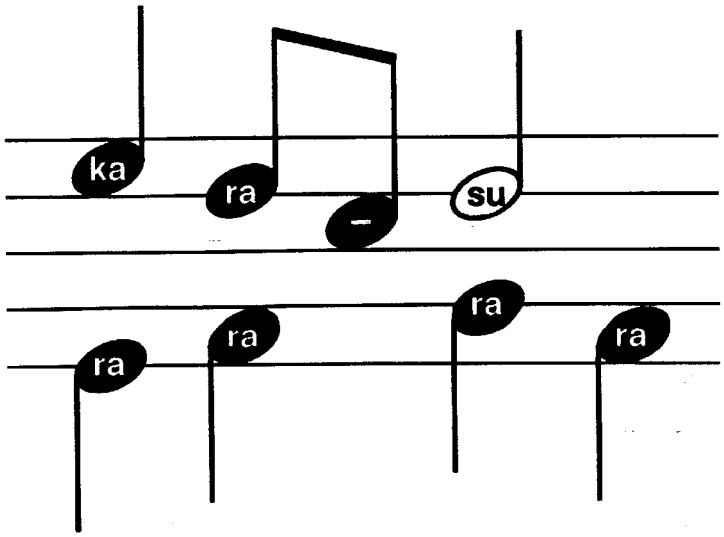
FIG. 8 illustrates the structure of sound data according to the second embodiment.
FIG. 9 illustrates the musical notation for a choral arrangement.

In step S32, letter(s) (lyrics information) displayed on the note is read out of the RAM 23 and written into lyrics information column 25*b* of a data table as shown in FIG. 8. The table is formed in the RAM 23.

In step S33, the position of the head of the note on the scale is detected as pitch information. The pitch information is written into pitch information column 25*c* of the table in FIG. 8.

In step S34, the shape of the note is distinguished as duration information. The duration information is written into duration information column 25*d* of the table in FIG. 8.

In step S35, whether all the notes were analyzed or not is determined. If NO, the process returns to step S31 to repeat the above operation to the next note. If YES in step S35, the process ends.

Thus, the notes shown in FIG. 6 are stored, as sound data 25a having the data structure as shown in FIG. 8, into the auxiliary storage 25. In FIG. 8, the lyrics information 25*b* includes information indicative of one or more syllables of the lyrics; the pitch information 25*c*, information indicative of the pitch corresponding to the lyrics information; the duration information 25*d*, information indicative of the duration of the corresponding note.

The sound synthesizer 26 synthesizes a song employing, e.g. synthesis-by-rule.

As described above, the sound processing apparatus according to the second embodiment enables easy and precise analysis of a music score for a machine to generate a song by correlating one or more syllables of lyrics with a corresponding note.

It should be noted that the above musical notation as displayed on the display 28 can be applied to a choral arrangement. FIG. 9 shows an example of such choral arrangement. In this case, the sound data are separately generated for the upper part and the lower part. The two sound data are synchronized for reproduction.

It should be noted that the sound data includes the lyrics information, pitch information and duration information, however, the sound data is not limited to these information. For example, timbre, volume/stress, tempo can be information for synthesized-audio output.

As described above, according to the sound and/or image processing apparatus of the present invention, assigning a part of the sound data as a synchronizing signal generates a synchronizing signal without increasing the quantity of data.

Further, according to the sound processing apparatus of the present invention, a music score displaying method provides an easy and accurate analysis of the music score to enable a machine to sing it.

It is evident that instead of using one bit position of the sound data, an additional bit can be used such that the quality of sound data is not reduced.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A data processing apparatus comprising:

display means for displaying a score image in which a note put on a staff includes at least a letter on a note head of the note, based on stored data;

extraction means for extracting, from the stored data, the letter included in the note head in the source image;

detection means for detecting a position of the note head in the score image based on the stored data;

distinguishing means for distinguishing a characteristic of the note in the score image based on the stored data; and sound-synthesizing means for synthesizing sound using the letter extracted by said extraction means, the position of the note head detected by said detection means and the characteristic distinguished by said distinguishing means.

2. The apparatus according to claim 1, wherein the stored data includes score data and letter data, wherein each letter of the letter data is assigned to each note of the score data.

3. The apparatus according to claim 1, wherein the letter represents a phonetic symbol.

4. The apparatus according to claim 1, wherein the position of the note head of the note, detected by said detection means, represents one of pitches of a musical scale.

5. The apparatus according to claim 1, wherein the characteristic is a shape of the note.

6. The apparatus according to claim 1, further comprising output means for outputting from a speaker the sound synthesized by said sound-synthesizing means.

7. The apparatus according to claim 1, further comprising storing means for storing into an auxiliary storage the letter extracted by said extraction means.

8. The apparatus according to claim 1, further comprising storing means for storing into an auxiliary storage the position of the note head detected by said detection means.

9. The apparatus according to claim 1, further comprising storing means for storing into an auxiliary storage the characteristic distinguished by said distinguishing means.

10. The apparatus according to claim 1, further comprising storing means for storing into an auxiliary storage data obtained by execution of said extraction means, said detection means and said distinguishing means, and wherein said sound-synthesizing means synthesizes sound using data stored in the auxiliary storage.

11. A data processing method comprising:

a displaying step of displaying a score image in which a note put on a staff includes at least a letter on a note head of the note, based on stored data;

an extraction step of extracting, from the stored data, the letter included in the note head in the score image;

a detection step of detecting a position of the note head in the score image based on the stored data;

a distinguishing step of distinguishing a characteristic of the note in the score image based on the stored data; and a sound-synthesizing step of synthesizing sound using the letter extracted at said extraction step, the position of the note head detected at said detection step and the characteristic of the note distinguished at said distinguishing step.

12. The method according to claim 11, wherein the stored data includes score data and letter data, wherein each letter of the letter data is assigned to each note of the score data.

13. The method according to claim 11, wherein the letter represents a phonetic symbol.

14. The method according to claim 11, wherein the position of the note head of the note, detected at said detection step, represents one of pitches of a musical scale.

15. The method according to claim 11, wherein the characteristic is a shape of the note.

16. The method according to claim 11, further comprising an output step of outputting from a speaker the sound synthesized in said sound-synthesizing step.

17. The method according to claim 11, further comprising a storing step of storing into an auxiliary storage the letter extracted by said extraction step.

18. The method according to claim 11, further comprising a storing step of storing into an auxiliary storage the position of the note head detected by said detection step.

19. The method according to claim 11, further comprising a storing step of storing into an auxiliary storage the characteristic distinguished by said distinguishing step.

20. The method according to claim 11, further comprising a storing step of storing into an auxiliary storage data obtained by execution of said extraction step, said detection step and said distinguishing step, and wherein, in said sound-synthesizing step, sound is synthesized by using data stored in the auxiliary storage.

21. A computer program product comprising a computer readable medium having computer program code, for executing sound synthesizing, said product including:

displaying process procedure codes for displaying a score image in which a note put on a staff includes at least a letter on a note head of the note, based on stored data;

extraction process procedure codes for extracting, from the stored data, the letter included in the note head in the score image;

detection process procedure codes for detecting a position of the note head in the score image based on the stored data;

distinguishing process procedure codes for distinguishing a characteristic of the note in the score image based on the stored data; and storing process procedure codes for storing data into a memory, the data including the letter extracted by executing the extraction procedure process codes, the position of the note head detected by executing the detection procedure process codes and the characteristic of the note distinguished by executing the distinguishing process procedure codes.

22. The computer program product according to claim 21, further comprising transferring to a sound-synthesizing unit the stored data by executing the storing process procedure codes.

* * * * *

UNITED STATES PATENT AND TRADEMARK OFFICE

CERTIFICATE OF CORRECTION

PATENT NO. : 5,806,039

DATED : September 8, 1998

INVENTOR(S) : TOSHIAKI FUKADA ET AL.

It is certified that error appears in the above-identified patent and that said Letters Patent is hereby corrected as shown below:

Title Page

Line [56], "5,189,702 2/1993 Sakurai et al. .....381/51, and 5,220,629 6/1993 Kosaka et al. .....381/52" should be added.
Line [63] "Continuation-in-part" should read --Continuation--.

COLUMN 4

Line 4, "affect" should read --effect--.
Line 41, "letter" should be deleted.

Signed and Sealed this

Twenty-fifth Day of May, 1999

*Attest:*

Q. TODD DICKINSON

*Attesting Officer*

*Acting Commissioner of Patents and Trademarks*